United States Patent [19]

Naiki

[11] Patent Number: 4,659,961

[45] Date of Patent: Apr. 21, 1987

[54] CUP MEMBER OF AN IN-LINE ELECTRON GUN CAPABLE OF REDUCING A COMA ABERRATION

[75] Inventor: Kazuaki Naiki, Tokyo, Japan

[73] Assignee: NEC Corporation, Japan

[21] Appl. No.: 899,758

[22] Filed: Aug. 21, 1986

Related U.S. Application Data

[63] Continuation of Ser. No. 661,363, Oct. 16, 1984, abandoned.

[30] Foreign Application Priority Data

Oct. 17, 1983 [JP] Japan ..... 58-193793
Oct. 17, 1983 [JP] Japan ..... 58-193794

[51] Int. Cl.[4] ..... H01J 29/51; H01J 29/76

[52] U.S. Cl. ..... 313/413; 313/412; 313/414; 313/440; 315/14

[58] Field of Search ..... 313/412, 413, 414, 449, 313/450, 458, 440, 421; 315/399, 408, 14, 15

[56] References Cited

U.S. PATENT DOCUMENTS 4,225,804 9/1980 Bekaert et al. ..... 313/412
4,415,831 11/1983 Konosu ..... 313/413

FOREIGN PATENT DOCUMENTS 0051863 4/1977 Japan ..... 313/412
0013769 2/1979 Japan ..... 313/449
0052843 5/1981 Japan ..... 313/412

*Primary Examiner*—Palmer C. DeMeo
*Assistant Examiner*—M. Razavi
*Attorney, Agent, or Firm*—Laff, Whitesel, Conte & Saret

[57] ABSTRACT

For use in an in-line electron gun of a cathode ray tube, a cup member comprises a planar plate having three apertures aligned with one another and a collar portion protruded from the planar plate. A height of the collar portion is between 2 mm and 6 mm, both inclusive. The collar portion may be either uniform in height or divided into a first pair of protrusions transversely of a predetermined straight line passing through the three apertures and a second pair of protrusions contiguous to the first pair of protrusions and lower in height than the first pair of protrusions.

4 Claims, 8 Drawing Figures

CUP MEMBER OF AN IN-LINE ELECTRON GUN CAPABLE OF REDUCING A COMA ABERRATION

This is a continuation of U.S. patent application Ser. No. 06/661,363, filed Oct. 16, 1984, now abandoned.

BACKGROUND OF THE INVENTION

This invention relates to a cup member for use in a color cathode ray tube in controlling three electron beams emitted from an in-line electron gun.

A color cathode ray tube is already known, which comprises an in-line electron gun. Three electron beams emitted from the in-line electron gun as a central beam and outside beams, are deflected horizontally and vertically by a deflection yoke disposed in a funnel portion of the cathode ray tube to form rasters on a phosphor screen through a shadow mask. A coma aberration generally arises due to a deflection sensitivity difference between the center and the outside beams. The coma aberration has been minimized by adjusting a horizontal deflecting magnetic field produced by the horizontal deflection yoke in a known manner. Despite the adjustment, it has been impossible to perfectly clear off the coma aberration. As will later be described more in detail, a cup member is used for the three electron beams with a view to perfectly clear off the coma aberration.

A conventional cup member has, however, insufficient to perfectly clear off the coma aberration when a high horizontal deflecting frequency is used to the cathode ray tube.

SUMMARY OF THE INVENTION

It is therefore an object of the present invention to provide a cup member for use in a self-convergent color cathode ray tube comprising an in-line electron gun for emitting three electron beams, which cup member is for preventing a coma aberration from occurring in a raster formed by three electron beams even with an increased horizontal deflecting frequency.

A cup member according to this invention is for use in combination with a color cathode ray tube comprising a face plate, a funnel portion having a first end joined to the face plate and a second end opposite to the first end and closed to define a hollow space in cooperation with the face plate, and an in-line electron gun enclosed in the hollow space adjacent to the second end and provided with three beam exits which are for three electron beams, respectively, and are aligned on a straight line. The cup member is placed between the beam exits and the face plate adjacently of the beam exits for individually controlling the three electron beams. The cup member comprises a planar plate having three internal surfaces defining three apertures, respectively, which can be aligned with the three beam exits for allowing the three electron beams to pass therethrough, and a collar portion protruded towards the electron gun from the planar plate and having a pair of first protrusions transversely of a predetermined straight line passing through the apertures and a pair of second protrusions contiguous to the first protrusions. Each second protrusion has a height selected between 2 mm and 6 mm, both inclusive.

DESCRIPTION OF THE PREFERRED EMBODIMENTS

Figure 1:
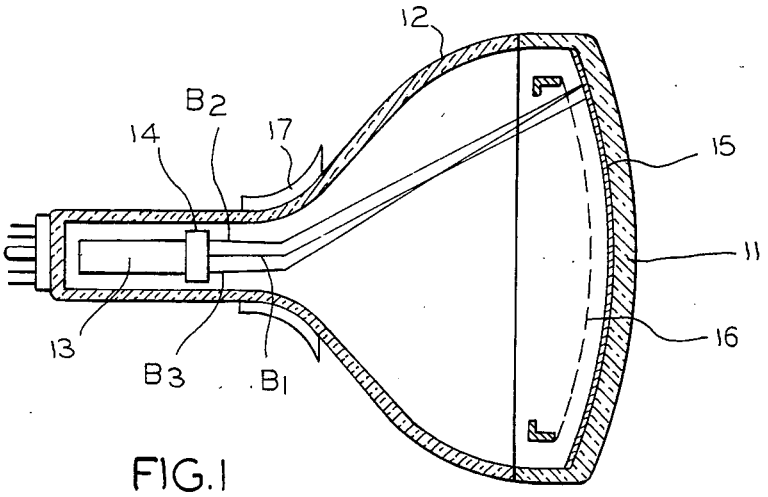
FIG. 1 is a longitudinal sectional view of a color cathode ray tube comprising an in-line electron gun.

Referring to FIG. 1, a color cathode ray tube will be described at first in order to facilitate an understanding of the present invention. The illustrated color cathode ray tube comprises a face plate 11, a funnel portion 12, an in-line electron gun 13 and a cup member 14. The cup member 14 will be later described. The funnel portion 12 has a first end joined to the face plate 11 and a second end opposite to the first end. The funnel portion 12 is closed to define a hollow space in cooperation with the face plate 11. A phosphor screen 15 is formed on the inside surface of the face plate 11. A shadow mask 16 is disposed in the hollow space adjacently inwardly of the phosphor screen 15. The in-line electron gun 13 is enclosed in the hollow space adjacent to the second end of the funnel portion 12 and is provided with three beam exists (now shown) which are for three electron beams consisting of a central electron beam $B_1$ and two outside electron beams $B_2$ and $B_3$. The three beam exits are aligned on a straight line in the manner which will later be described. The cup member 14 is placed between the beam exits and the face plate 11.

The central electron beams $B_1$ and the outside electron beams $B_2$ and $B_3$ are radiated from the in-line electron gun 13. The central electron beam $B_1$ and the outside electron beams $B_2$ and $B_3$ are deflected horizontally and vertically by horizontal and vertical deflection yokes 17 disposed around the funnel portion 12 to form a raster on the phosphor screen 15 through the shadow mask 16. The phosphor screen 15 has a plurality of phosphor screen elements which are luminous in three colors. The deflection yokes 17 are for producing horizontal and vertical deflecting fields $F_H$ and $F_V$. As everybody knows, the horizontal and the vertical deflecting fields are adjusted to operate the color cathode ray tube of the self-convergence type.

Figure 2:
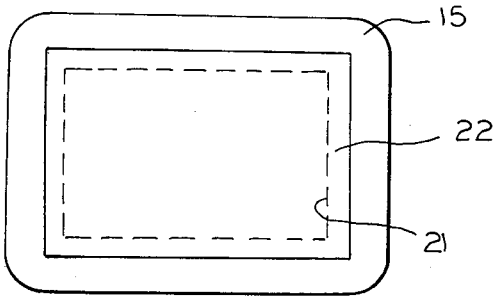
FIG. 2 is a front view on a phosphor screen of the color cathode ray tube and a raster formed on the phosphor screen by three electron beams emitted from the in-line electron gun.

Turning to FIG. 2, the central electron beam $B_1$ produces a first raster 21 on the phosphor screen 15. The outside electron beams $B_2$ and $B_3$ produce a second raster 22 on the phosphor screen 15. The first raster 21 is narrower in areas than the second raster 22. A coma aberration arises from a deflection sensitivity difference between the center and the outside electron beams $B_2$ and $B_3$. In order to reduce the coma aberration, the cup member 14 is disposed to cover the beam exits of the in-line electron gun 13. The cup member 14 is for bringing the first and the second rasters 21 and 22 coincident with each other.

Figure 3:
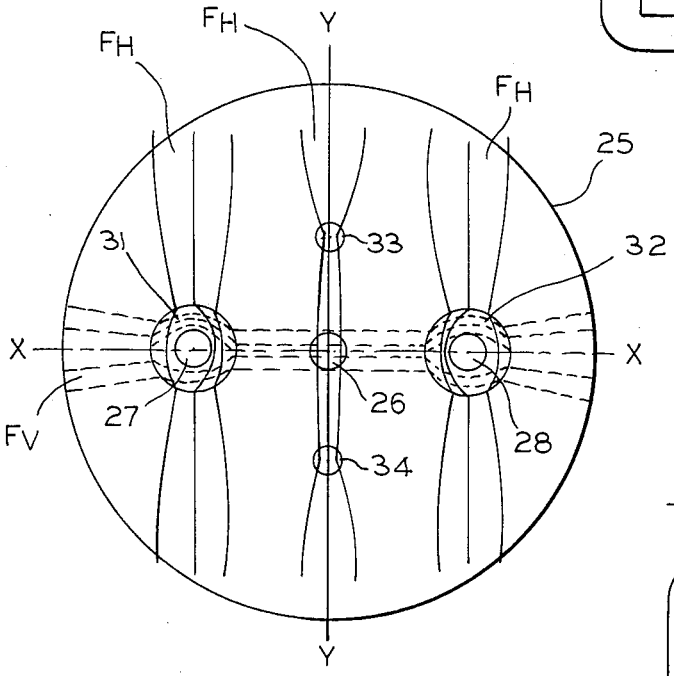
FIG. 3 is an enlarged plan view of a planar plate of a conventional cup member.

Referring to FIG. 3, the cup member 14 comprises a planar plate 25 and a cylindrical collar portion (not shown). The planar plate 25 has a central aperture 26 and two outside apertures 27 and 28 in correspondence to the three beam exits for the central electron beam $B_1$ and the two outside electron beams $B_2$ and $B_3$, respectively. The three apertures 26 through 28 are aligned on a horizontal axis X—X which is parallel to the horizontal scanning line on the phosphor screen 15. Magnetic shield rings 31 and 32 are disposed to surround the outside apertures 27 and 28, respectively. A pair of disc magnetic enhancers 33 and 34 are opposite to each other relative to the central aperture 26. The disc magnetic enhancers 33 and 34 are disposed on a vertical axis Y—Y which is perpendicular to the horizontal scanning line.

The mangnetic enhancers 33 and 34 act for the central electron beam $B_1$ to enhance the deflection sensitivity of the horizontal deflecting field $F_H$ so that the sensitivity is greater for the central electron beam $B_1$ than the sensitivity for each outside electron beam $B_2$ and $B_3$. The magnetic shield rings 31 and 32 are for the respective outside electron beams $B_2$ and $B_3$ to decrease the deflection sensitivity of the horizontal deflecting field $F_H$ and the vertical deflecting field $F_V$ of the deflection yokes 17 to a level which is lower than the level for the central electron beam $B_1$. The magnetic shield rings 31 and 32 are operable additionally on the central electron beam $B_1$ to enhance the deflection sensitivity of the vertical deflecting field $F_V$ of the deflecting yokes 17. As a result, the first raster 21 (FIG. 2) is enlarged horizontally and vertically by the magnetic shield rings 31 and 32 and the magnetic enhancers 33 and 34. On the contrary, the second raster 22 is reduced both horizontally and vertically. The coma aberration caused by the deflecting fields of the deflection yokes 17 is removed when the first and the second rasters 21 and 22 coincide completely with each other.

It is to be noted in connection with the above that a horizontal deflecting frequency $f_h$ is rendered higher than 15.75 KHz used in the current NTSC television system in order to increase the number of scanning lines for a high resolution display. In this event, the coma aberration arises on the first and the second rasters 21 and 22 (FIG. 2) produced by the central electron beam $B_1$ and by the both outside electron beams $B_2$ and $B_3$.

Figure 4:
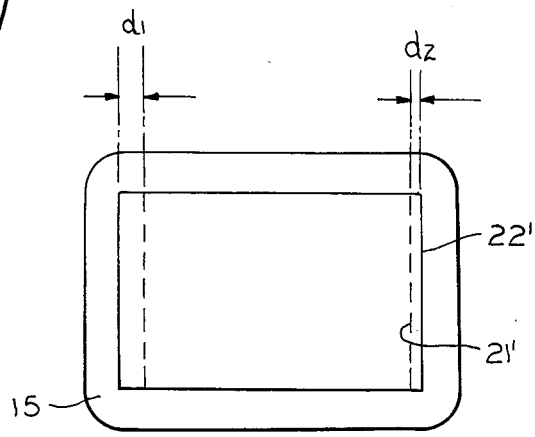
FIG. 4 is a front view of the raster of the type shown in FIG. 2 for use in describing a coma aberration caused to the raster with an increased horizontal deflecting frequency.

Turning to FIG. 4, a first raster 21' is formed by the central electron beam $B_1$. A second raster 22' is formed by both of the outside beams $B_2$ and $B_3$. The second raster 22' is enlarged somewhat horizontally as compared with the first raster 21'. More particularly, the second raster 22' is enlarged leftwards by a first displacement $d_1$ on the phosphor screen 15 and rightwards by a second displacement $d_2$. The first displacement $d_1$ is larger than the second displacement $d_2$. The displacements of the first and the second rasters 21' and 22' may be called convergence errors. The convergence errors seriously degrade the pictures displayed on the phosphor screen 15.

In the NTSC television system, the horizontal deflecting frequency is 15.75 KHz. When the horizontal deflecting frequency is doubled to 31.5 KHz and is designated by $f_h$ in the color cathode ray tube of a 20-inch and 90-degree deflection type, the first displacement $d_1$ is equal to 0.7 mm. The second displacement $d_2$ is 0.3 mm.

As described above, the coma aberration increases on the first and the second rasters 21' and 22' with an increase in the horizontal deflecting frequency $f_h$. The reasons will be described hereinunder with reference to FIGS. 1 and 3. It has been found out that the increase of coma aberration results from an eddy current which flows through the collar portion of the cup member 14 when the cathode ray tube is operated.

More particularly, a horizontal deflection magnetic field is produced along the vertical axis Y—Y (FIG. 3) by the deflection yoke 17 (FIG. 1) to deflect the three electron beams $B_1$, $B_2$, and $B_3$. The horizontal deflection magnetic field partially intersects the collar portion of the cup member 14. In particular, a magnetic flux of the horizontal deflection magnetic field penetrates partial regions of the collar portion which are transverse to the horizontal axis X—X. Under the circumstances, the eddy current flows in the partial regions when the horizontal deflection magnetic field is varied. The eddy current induces a resultant magnetic flux which acts to prevent the horizontal deflection magnetic field from being varied. Thus, the resultant magnetic flux somewhat cancels the magnetic flux of the horizontal deflection magnetic field and reduces deflection sensitivity of the electron beams $B_1$, $B_2$, and $B_3$.

Such an influence of the eddy current or the resultant magnetic flux gives rise to no substantial problem when the horizontal deflection frequency $f_h$ is equal to 15.75 KHz or so. However, the influence of the eddy current becomes serious with an increase of the horizontal deflection frequency $f_h$. For example, each of the outside electron beams $B_2$ and $B_3$ forms the second raster 22' (FIG. 4) horizontally enlarged in comparison with the first raster 21' formed by the central electron beam $B_1$.

Figure 5:
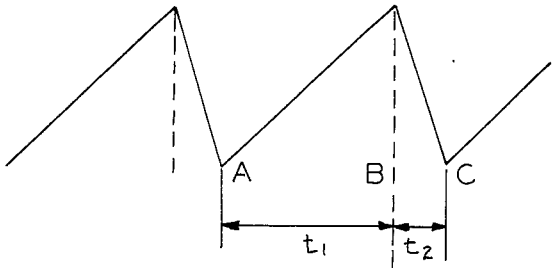
FIG. 5 is a waveform diagram of a current flowing in a horizontal deflecting coil of a deflecting yoke.

Turning to FIG. 5 together with FIGS. 3 and 4, description will be made as regards asymmetry of the coma aberration, as shown in FIG. 4. As well known in the art, a horizontal deflection coil of the deflection device is supplied with a saw tooth current which has a predetermined period divisible into a horizontal scanning duration $t_1$ and a horizontal blanking duration $t_2$ approximately equal to one fifth of the horizontal scanning duration $t_1$. In FIG. 5, the horizontal scanning duration $t_1$ begins at a first time instant A and ends at a second time instant B while the horizontal blanking duration $t_2$ lasts between the second time point B and a third time instant C. The first and the second time instants A and B correspond to a left and a right side end of each raster, respectively. The third time instant C is coincident with the first time instant A and corresponds to the left side end of each raster.

This means that the current flowing within the horizontal blanking duration varies at a rate which is about five times that of the current flowing within the horizontal scanning duration. As a result, the horizontal deflection magnetic field is drastically changed within the horizontal blanking duration in comparison with the horizontal scanning duration. Accordingly, the eddy current increases within the horizontal blanking duration, As a result, the influence of the eddy current strongly appears on the left side end of each raster as compared with the right side end thereof. Thus, the first displacement $d_1$ on the lefthand side of FIG. 4 becomes wider than the second displacement $d_2$. The coma aberration becomes asymmetrical with respect to the vertical axis Y—Y as shown in FIG. 4.

The asymmetry of the coma aberration is based on a difference between the rates of variation of the currents flowing within the horizontal scanning duration and the horizontal blanking duration. A recent trend is to shorten the horizontal blanking duration to get a more wider display screen area. This aggravates the asymmetry of the coma aberration.

Figure 6:
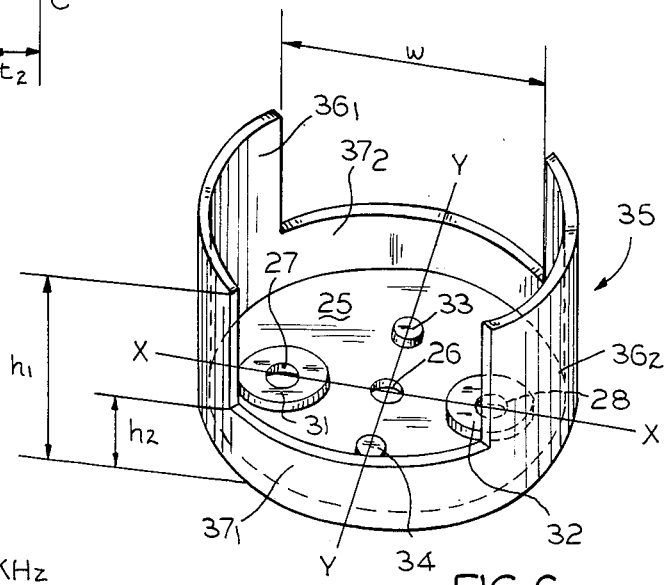
FIG. 6 is a perspective view of a cup member for use in combination with a color cathode ray tube according to an embodiment of this invention.

Referring now to FIG. 6, a cup member according to a first embodiment of this invention is for use in a color cathode ray tube. In the manner described above, the cup member comprises a planar plate 25 and a cylindrical collar portion 35. The cup member is made of a non-magnetic material. The illustrated collar portion 35 has an end periphery and a pair of indents from the end periphery towards the planar plate 25. More particularly, the collar portion 35 has a pair of first or primary protrusions $\mathbf{36}_1$ and $\mathbf{36}_2$ transversely of the horizontal axis X—X and a pair of second or secondary protrusions $\mathbf{37}_1$ and $\mathbf{37}_2$ contiguous to the first protrusions $\mathbf{36}_1$ and $\mathbf{36}_2$. The horizontal axis X—X passes through the central and the outside apertures 26 through 28 and may be called a predetermined straight line. In other words, the first protrusions $\mathbf{36}_1$ and $\mathbf{36}_2$ are in alignment with the horizontal axis X—X which is parallel to the horizontal scanning line on the phosphor screen 15. A chord W subtends each of the second protrusions $\mathbf{37}_1$ and $\mathbf{37}_2$ and has a length longer than a distance between the outside apertures 27 and 28. The distance is measured between center positions of the outside apertures 27 and 28.

In the example being illustrated, the first protrusions $\mathbf{36}_1$ and $\mathbf{36}_2$ are higher than the second protrusions $\mathbf{37}_1$ and $\mathbf{37}_2$. As illustrated in FIG. 6, let the first and the second protrusions 36 and 37 (suffixes omitted) have first and second heights denoted by $h_1$ and $h_2$, respectively.

Figure 7:
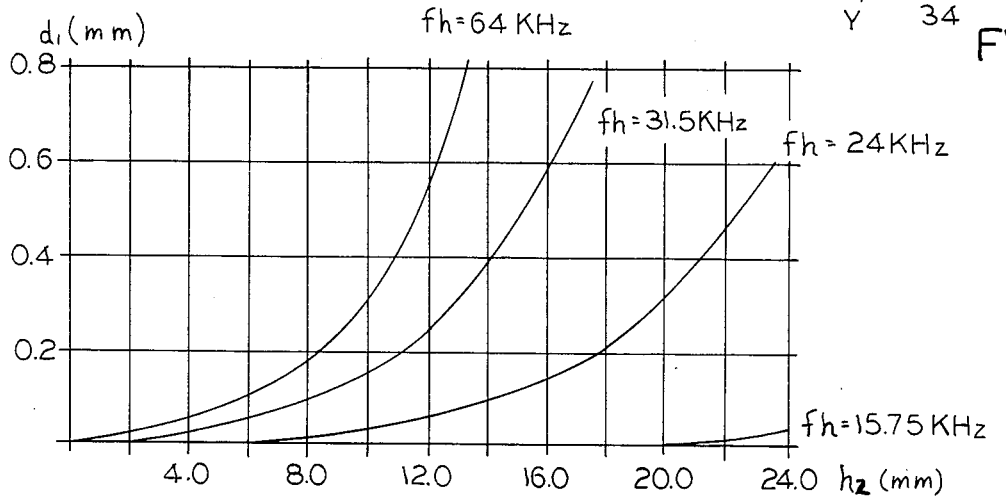
FIG. 7 is a diagram showing relationships between a height of a collar portion of the cup member depicted in FIG. 6 and a coma aberration.

Referring to FIG. 7 in addition to FIG. 6, a relationship between the second height $h_2$ of each second protrusion 37 and the first displacement $d_1$ (FIG. 4) resulting from the coma aberration will be described by using the horizontal deflecting frequency $f_h$ as a parameter for the color cathode ray tube of the 20-inch and 90-degree deflection type.

When the second height $h_2$ is higher than 8.0 mm, the first displacement $d_1$ exceeds 0.1 mm and rapidly increases at the frequency $f_h$=24, 31.5 and 64 KHz. When $h_2$=8,0 mm, the first displacement $d_1$ is equal to 0.09 mm and 0.18 mm at the frequencies $f_h$ of 31.5 KHz and 64 KHz, respectively. Likewise, the first displacement $d_1$ is equal to 0.05 mm and 0.1 mm at the frequencies of 31.5 KHz and 64 KHz, respectively, when $h_2$=6.0 mm.

In general, a picture quality due to misconvergence is degraded when such a displacement is not smaller than 0.2 mm. On the other hand, the coma aberration brings about no serious problem when the displacement $d_1$ is lower than 0.1 mm. In other words, misconvergence can be visually neglected. As will readily be understood, the second height $h_2$ should be equal to or lower than 6 mm in consideration of the coma aberration.

It is assumed that the collar portion 14 becomes shorter than 2 mm. In this event, much inconvenience arises from such a shortened collar portion 14. More specifically, a bulb spacer (not shown) is attached to the second protrusions $\mathbf{37}_1$ and $\mathbf{37}_2$ to fixedly support the cup member 14 between the beam exits of the in-line electron gun 13 and the face plate 11. An anode voltage between 20 KV and 30 KV is supplied to the cup member 14 from an anode button (not shown) through both of the bulb spacer and a conductive coating (not shown) covered on an internal surface of the funnel portion 12.

A getter support (not shown also) is often attached to the second protrusions $\mathbf{37}_1$ and $\mathbf{37}_2$ so as to evacuate the cathode ray tube to a high degree of vacuum.

The shortened collar portion as mentioned above makes it difficult to fix the bulb spacer and the getter support to the second protrusions $\mathbf{37}_1$ and $\mathbf{37}_2$.

In addition, the conductive coating is usually extended to a predetermined position of the funnel portion 12 through a neck thereof and has an end portion at the predetermined position. The shortened collar portion 14 must be electrically connected to the conductive coating with the shortened collar portion 14 displaced from the end portion of the conductive coating towards the face plate 11. Under the circumstances, the end portion of the conductive coating is left uncovered with the shortened collar portion 14 and is electrified by instable positive electric charges when the anode voltage is supplied to the conductive coating. The electric charges adversely affect the three electron beams $B_1$, $B_2$, and $B_3$ and disturb paths of the electron beams $B_1$, $B_2$, and $B_3$.

According to the inventor's experimental studies, it has been found out that the collar portion should be at least 2 mm high so as to fix the cup member 14 to the bulb spacer or getter support and to avoid undesired electrification of the end portion of the conductive coating.

Figure 8:
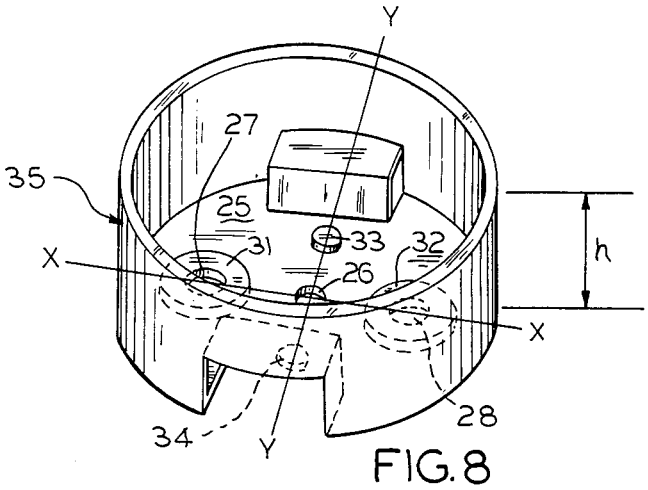
FIG. 8 is a perspective view of a cup member for use in combination with a color cathode ray tube according to another embodiment of this invention.

Referring to FIG. 8, a cup member according to a second embodiment of this invention is for use in a color cathode ray tube. The illustrated collar portion 35 of the cup member 14 has a uniform height h. This means that the first and the second protrusions are equal in height to each other. The height may be denoted by h. With this structure, it is possible to accomplish characteristics similar to those illustrated in FIG. 7.

As mentioned in conjunction with FIG. 7, the first displacement $d_1$ should be equal to or smaller than 0.1 mm even when the frequency $f_h$ is equal to 64 KHz. In this case, the collar portion must be at least 2 mm high, as mentioned in conjunction with FIG. 7. Therefore, the height h of the collar portion should be between 2 mm and 6 mm.

While this invention has thus far been described in conjunction with embodiments thereof, it will readily be possible for those skilled in the art to put this invention into practice in various other manners. For example, the first protrusions 36 (FIG. 6) may be lower than the second protrusions.

What is claimed is:

1. A cup member for use in combination with a color cathode ray tube comprising a face plate, a funnel portion for receiving a deflection yoke means and having a first end joined to said face plate and a second end opposite to said first end, said second end being closed to define within said funnel portion a hollow space in cooperation with said face plate, an in-line electron gun enclosed in said hollow space adjacent to said second end, said gun having three beam exits which are for three electron beams, respectively, said three beam exits being aligned on a predetermined straight line to form rasters, said deflecting yoke means being positioned outside said hollow space for deflecting said three electron beams along said straight line, said beams being deflected at a high horizontal deflection frequency which produces a coma aberration that said deflection yoke means cannot adequately minimize, said high horizontal deflecting frequency being higher than 15.75 kHz, said cup member being positioned between said beam exits and said face plate adjacent said exits so as to individually control said three electron beams, said cup member reducing the coma aberration which appears on said rasters at said high horizontal deflecting frequency and which said deflection yoke means cannot minimize, said cup member comprising:

a planar plate having three apertures formed along said predetermined straight line; and a collar portion having a part of first protrusions extending transversely of said predetermined straight line passing through said three apertures, and a pair of second protrusions contiguous to said first protrusions, each second protrusion having a height in the range of 2 mm to 6 mm, inclusive, so as to make said asymmetrical coma aberration which cannot be corrected by said deflection yoke means substantially negligible at said specific horizontal deflecting frequency.

2. A cup member as claimed in claim 1, wherein said first protrusions are substantially equal in height to said second protrusions.

3. A cup member as claimed in claim 1, wherein said first protrusions are more protruded than said second protrusions.

4. A cup member as claimed in claim 1, wherein each of said planar plate and said collar portion is of a non-magnetic material.

* * * * *